US011033445B1

(12) United States Patent
Richter

(10) Patent No.: US 11,033,445 B1
(45) Date of Patent: Jun. 15, 2021

(54) MOTION-BASED POWER ASSIST SYSTEM FOR WHEELCHAIRS

(71) Applicant: Max Mobility, LLC, Antioch, TN (US)

(72) Inventor: W. Mark Richter, Nashville, TN (US)

(73) Assignee: MAX MOBILITY, LLC, Lebanon, TN (US)

( * ) Notice: Subject to any disclaimer, the term of this patent is extended or adjusted under 35 U.S.C. 154(b) by 0 days.

(21) Appl. No.: 15/218,937

(22) Filed: Jul. 25, 2016

Related U.S. Application Data

(63) Continuation of application No. 13/543,598, filed on Jul. 6, 2012, now Pat. No. 9,398,990.

(60) Provisional application No. 61/504,949, filed on Jul. 6, 2011.

(51) Int. Cl.
*A61G 5/04* (2013.01)

(52) U.S. Cl.
CPC ..... *A61G 5/04* (2013.01); *A61G 5/045* (2013.01); *A61G 2005/048* (2013.01); *A61G 2203/12* (2013.01); *A61G 2203/36* (2013.01)

(58) Field of Classification Search
CPC ..... B60K 2001/001
USPC ..... 180/65.1, 65.51, 65.6
See application file for complete search history.

(56) References Cited

U.S. PATENT DOCUMENTS 2,448,992 A 9/1948 Love et al.
2,495,573 A * 1/1950 Duke ..... A61G 5/047 180/11
3,905,437 A * 9/1975 Kaiho ..... A61G 5/047 180/15
4,207,959 A 6/1980 Youdin et al.
4,260,035 A 4/1981 Loveless et al.
4,386,672 A * 6/1983 Coker ..... A61G 5/047 180/13
4,422,515 A 12/1983 Loveless
4,652,026 A 3/1987 Byrge
4,728,812 A 3/1988 Sheriff et al.
4,759,418 A * 7/1988 Goldenfeld ..... A61G 5/047 180/65.1
4,767,940 A 8/1988 Tuttle
4,770,431 A 9/1988 Kulik
(Continued)

FOREIGN PATENT DOCUMENTS

DE 300247 1/1917
DE 1323937 7/1993
(Continued)

OTHER PUBLICATIONS

European Patent Office, Extended European Search Report, Application No. 17162833.2-1651, dated Oct. 27, 2017, 6 pages.
(Continued)

*Primary Examiner* — Jeffrey J Restifo
(74) *Attorney, Agent, or Firm* — McAndrews, Held & Malloy, Ltd.

(57) ABSTRACT

A motion-based push activation power assist system for manual wheelchairs. The system uses motion-based measurements to determine when the user applies a push to the wheelchair handrims and brakes with the handrims. The push recognition activates a drive system that provides an assistive driving force-pulse to the wheelchair to reduce the demand on the user during propulsion. The brake recognition deactivates the power assist. The provided power assist is proportional to the sensed push and can be modulated to different proportional settings.

19 Claims, 5 Drawing Sheets

(56) References Cited

U.S. PATENT DOCUMENTS 4,823,900 A 4/1989 Farnam
4,926,952 A 5/1990 Farnam
5,113,959 A * 5/1992 Mastov ..... A61G 5/047 180/11
5,135,063 A * 8/1992 Kropf ..... A61G 5/047 180/13
5,222,567 A * 6/1993 Broadhead ..... A61G 5/047 180/15
5,234,066 A * 8/1993 Ahsing ..... A61G 5/045 180/11
5,244,051 A * 9/1993 Wu ..... A61G 5/047 180/13
5,351,774 A * 10/1994 Okamoto ..... A61G 5/047 180/11
5,366,037 A * 11/1994 Richey ..... A61G 5/045 180/6.5
5,494,126 A * 2/1996 Meeker ..... A61G 5/047 180/13
5,555,949 A * 9/1996 Stallard ..... A61G 5/045 180/6.5
5,651,422 A * 7/1997 Casali ..... A61G 5/047 180/13
5,818,189 A * 10/1998 Uchiyama ..... A61G 5/045 180/907
5,826,670 A * 10/1998 Nan ..... A61G 5/047 180/15
5,878,829 A * 3/1999 Kanno ..... A61G 5/045 180/65.51
5,927,414 A * 7/1999 Kan ..... A61G 5/045 180/19.3
6,059,060 A * 5/2000 Kanno ..... A61G 5/045 180/65.51
6,112,837 A * 9/2000 Kanno ..... A61G 5/045 180/6.5
6,230,831 B1 * 5/2001 Ogata ..... A61G 5/045 180/65.1
6,290,014 B1 * 9/2001 MacCready, Jr. ..... B62M 7/16 180/205.1
6,302,226 B1 * 10/2001 Kanno ..... A61G 5/02 180/6.5
6,334,497 B2 1/2002 Odell
6,354,390 B1 * 3/2002 Uchiyama ..... A61G 5/045 180/6.5
6,360,836 B1 * 3/2002 Milano, Jr. ..... B62B 5/005 180/65.6
6,416,063 B1 7/2002 Stillinger et al.
6,459,962 B2 * 10/2002 Ulrich ..... A61G 5/045 180/65.1
6,481,514 B2 * 11/2002 Takada ..... A61G 5/047 180/11
6,571,892 B2 6/2003 Kamen et al.
6,702,051 B2 * 3/2004 Chu ..... A61G 5/047 180/13
6,729,421 B1 * 5/2004 Gluck ..... A61G 7/08 180/11
6,729,422 B2 * 5/2004 Chu ..... A61G 5/047 180/13
6,807,465 B2 * 10/2004 Ulrich ..... A61G 5/045 180/65.1
6,842,692 B2 1/2005 Fehr et al.
6,860,347 B2 * 3/2005 Sinclair ..... A61G 5/047 180/11
6,880,661 B1 * 4/2005 Oh ..... B62M 7/14 180/15
7,138,774 B2 11/2006 Negoro et al.
7,264,272 B2 9/2007 Mulhern et al.
7,311,160 B2 12/2007 Lim
7,383,107 B2 6/2008 Fehr et al.
7,383,904 B2 * 6/2008 Wu ..... A61G 5/02 180/65.51
7,404,465 B2 7/2008 Hsieh
7,425,007 B2 9/2008 Johannes de Kruijf
7,426,970 B2 9/2008 Olsen
7,566,102 B2 7/2009 Guile
7,581,604 B2 9/2009 Torita
7,648,156 B2 1/2010 Johanson
7,670,263 B2 3/2010 Ellis et al.
7,770,674 B2 * 8/2010 Miles ..... A61G 5/045 180/65.1
7,832,515 B2 * 11/2010 Barthelt ..... A61G 5/045 180/167
7,837,210 B2 11/2010 Kylstra et al.
7,886,854 B2 * 2/2011 Chiu ..... A61G 5/047 180/11
7,976,049 B2 7/2011 Chiu
8,038,165 B2 10/2011 Wang
8,127,875 B2 3/2012 Mattes et al.
8,181,992 B2 5/2012 Mulhern et al.
8,186,463 B2 5/2012 Hunziker et al.
8,261,867 B1 * 9/2012 Gainer ..... B60K 1/00 180/60
8,292,010 B2 10/2012 Puskar-Pasewicz et al.
8,292,678 B2 10/2012 Burgess, Jr.
8,306,673 B1 11/2012 Manning
8,413,749 B2 * 4/2013 Hsu ..... A61G 5/045 180/65.51
8,430,189 B2 * 4/2013 Tallino ..... A61G 5/047 180/11
8,556,279 B2 10/2013 McKinnon
8,602,138 B2 * 12/2013 Filkoski ..... B60K 1/02 180/65.1
8,652,009 B2 2/2014 Ellis et al.
8,758,191 B2 6/2014 Takenaka et al.
9,144,525 B2 * 9/2015 Richter ..... A61G 5/047
9,398,990 B2 * 7/2016 Richter ..... A61G 5/04
9,615,982 B2 * 4/2017 Richter ..... A61G 5/047
9,795,524 B2 * 10/2017 Richter ..... A61G 5/047
9,796,401 B1 * 10/2017 Ammirati ..... B62B 5/005
10,265,228 B2 * 4/2019 Richter ..... A61G 5/047
2002/0019686 A1 2/2002 Nathan et al.
2002/0171559 A1 11/2002 Yang
2003/0127261 A1 * 7/2003 Borroni-Bird ..... B60G 3/18 180/65.1
2003/0226698 A1 12/2003 Kamen et al.
2004/0251649 A1 12/2004 Wu
2005/0000742 A1 1/2005 Mulhern et al.
2005/0077694 A1 4/2005 Levi et al.
2005/0137652 A1 6/2005 Cauller et al.
2005/0236208 A1 10/2005 Runkles et al.
2006/0244249 A1 11/2006 Goertzen et al.
2006/0255581 A1 11/2006 Goertzen et al.
2007/0020985 A1 1/2007 Naitou et al.
2007/0039766 A1 2/2007 Jackson et al.
2007/0095580 A1 5/2007 Liao
2007/0095582 A1 5/2007 Stuijt et al.
2007/0131730 A1 6/2007 Mirzale
2007/0145711 A1 6/2007 Mulhern et al.
2007/0152427 A1 7/2007 Olsen
2007/0235234 A1 10/2007 De Kruijf
2007/0261897 A1 11/2007 Torita
2007/0283966 A1 12/2007 Maples
2008/0054596 A1 3/2008 Johanson
2008/0061627 A1 3/2008 Spector et al.
2008/0066974 A1 * 3/2008 Pearlman ..... A61G 5/043 180/22
2008/0300777 A1 12/2008 Fehr et al.
2009/0050381 A1 2/2009 Cheng
2009/0194974 A1 8/2009 Smith
2010/0022908 A1 1/2010 Cauller
2010/0036543 A1 2/2010 Bitzer et al.
2010/0300777 A1 12/2010 Tallino
2010/0301576 A1 12/2010 Dugas et al.
2011/0214929 A1 9/2011 Filkoski et al.
2012/0012416 A1 1/2012 Mirzaie
2012/0068435 A1 3/2012 Birmanns et al.
2012/0080243 A1 * 4/2012 Mulhern ..... A61G 5/047 180/11
2012/0138376 A1 6/2012 Zhou et al.
2012/0143400 A1 6/2012 Hinkel, III
2012/0144554 A1 6/2012 Thellmann

(56) References Cited

U.S. PATENT DOCUMENTS

| | | | | |
|---|---|---|---|---|
| 2012/0217081 | A1 | 8/2012 | Mulhern et al. | |
| 2012/0217713 | A1 | 8/2012 | Molnar | |
| 2013/0008732 | A1* | 1/2013 | Richter | A61G 5/04 180/167 |
| 2013/0080015 | A1 | 3/2013 | Strothmann et al. | |
| 2013/0218380 | A1 | 8/2013 | Phillips et al. | |
| 2013/0240271 | A1 | 9/2013 | Tallino | |
| 2013/0253769 | A1 | 9/2013 | Kamo et al. | |
| 2014/0058582 | A1 | 2/2014 | Jaenke et al. | |

FOREIGN PATENT DOCUMENTS

| | | | |
|---|---|---|---|
| DE | 19539487 | A1 | 4/1997 |
| DE | 19748201 | | 3/1999 |
| DE | 19857786 | | 9/1999 |
| DE | 29907846 | | 9/1999 |
| DE | 19848530 | | 2/2000 |
| DE | 102007004704 | | 8/2008 |
| EP | 1854443 | | 11/2007 |
| JP | 36304205 | | 11/1994 |
| JP | 39285501 | | 11/1997 |
| JP | 10314234 | | 12/1998 |
| JP | 2000084007 | | 3/2000 |
| JP | 2003052760 | | 2/2003 |
| JP | H10314234 | | 12/2003 |
| JP | 2009078044 | | 4/2009 |
| WO | 2013006818 | | 1/2013 |

OTHER PUBLICATIONS

European Patent Office, Extended European Search Report, Application No. 12807785.6-1651, dated Jun. 10, 2015, 5 pages.
International Preliminary Report on Patentability , PCT/US2012/045816, dated Jan. 7, 2014, 6 pages.
Brian D. Mayton, WristQue: A Personal Sensor Wristband for Smart Infrastructure and Control, submitted to the Program in Media Arts and Sciences, School of Architecture and Planning on Oct. 9, 2012, 72 pages.
Daniel Petersson, Jonas Johanssen, Ulf Holmberg and Bjorn Astrand, Torque Sensor Free Power Assisted Wheelchair, Proceedings of the 2007 IEEE 10th International Conference on Rehabilitation Robotics, Jun. 12-15, Noordwijk, The Netherlands, Jun. 12-15, 2007, Paper 7 pages, Abstract 1 page, Table of Contents 10 pages, and Halmstad University Post-Print 1 page, Total of 19 pages.
Jonas Johanssen, Daniel Petersson,Torque Sensor Free Power Assisted Wheelchair, Master's Thesis in Electrical Engineering, School of Information Science, Computer and Electrical Engineering, Halmstad University, Technical report, IDE0703, Jan. 2007, 78 pages.
Sehoon Oh, Yoichi Hori, Sensor Free Power Assisting Control Based on Velocity Control and Disturbance Observer, IEEE ISIE 2005, Jun. 20-23, 2005, Dubrovnik, Croatia, 6 pages.
Takashi Miyazawa, Seiichirou Katsura, Kouhei Ohnishi, A Power-Assisted Wheelchair Taking Running Environment Into Account, Copyright 2003 IEEE, 6 pages.
Rick N. Robertson, PhD, Michael L. Boninger, MD, Rory A. Cooper, PhD, Sean D. Shimada, MS, Pushrim Forces and Joint Kinetics During Wheelchair Propulsion, Arch Phys Med Rehabil vol. 77, Sep. 1996, 9 pages.
Sunrise Medical, WheelDrive manual, MD_WheelDrive_EU_DE_RevA_2016_11_17, 12 pages.
E-Move, Decon product brochure, 10 pages.
European Search Report, dated Jun. 10, 2015, 10 pages.
Sunrise Medical, WheelDrive Manual, TM_WheelDrive_EU_INT_Rev.2.0_2016_10_13, 32 pages.
Sunrise Medical GmbH, GER, Model: Krypton, product sheet for EU Market, 2 pages.
Max Mobility, Installation guide for adapter axis, 2 pages.
Sunrise Medical, WheelDrive, Brochure, 8 pages.
E-Move, Decon product brochure, 9 pages.
Alber GmbH, Twion Brochure, 12 pages.
Alber GmbH, e-motion brochure, 8 pages.
Alber GmbH, e-fix, 8 pages.

* cited by examiner

MOTION-BASED POWER ASSIST SYSTEM FOR WHEELCHAIRS

This application is a continuation of U.S. patent application Ser. No. 13/543,598, filed Jul. 6, 2012, which claims benefit of and priority to U.S. Provisional Application No. 61/504,949, filed Jul. 6, 2011, by Mark Richter, and is entitled to those filing dates for priority. The specifications, figures and complete disclosures of U.S. Provisional Application No. 61/504,949 and U.S. patent application Ser. No. 13/543,598 are incorporated herein in their entireties by specific reference for all purposes.

FIELD OF INVENTION

This invention relates to a power assist system for manual wheelchairs, specifically a system that employs motion-based sensing for recognition of user propulsion and braking.

BACKGROUND OF THE INVENTION

Manual wheelchairs are the primary mode of locomotion for millions of people around the world. Upper limb pain and injury is very common among these manual wheelchair users and can severely impact mobility, independence and quality of life. The most common types of injury are impingement syndrome of the shoulder and carpal tunnel syndrome of the wrist. Upper limb pain and injury is an emotionally, physically and financially costly problem.

Wheelchair propulsion is one activity that has been associated with the development of these upper extremity injuries. It is recommended that users reduce how hard they push on the handrim and to do it less frequently in order to reduce the stresses of propulsion on the upper body.

Prior art presents power attachment units that have been used to mount to manual wheelchairs to assist in propulsion. The typical power add-on, comparable to that disclosed in U.S. Pat. No. 4,759,418, which is incorporated herein by specific reference for all purposes, employs a linkage system that mounts to the wheelchair frame and trails in between the two rear wheels. An electric motor powers a drive wheel that is controlled by a push button located within reach of the user. This type of design, not common to all power attachments, also employs a steering bar that attaches to the front casters in order to guide the wheelchair when being driven by the power add-on. These electric drive attachments are known to be successful in helping to reduce the physical effort needed for propulsion. A drawback is that these types of systems completely eliminate the need for pushing because the user drives the wheelchair, rather than maneuvers it through pushes. In this situation, the user does not benefit from the physical exercise of manual propulsion or the psychological benefits of not being dependent on the device for transportation.

Another prior art is the push activated power assist wheels. These combine the benefits of manual push operation by the user and power assistance to reduce the demand on the user's upper extremities during propulsion. Push activated power assist wheels, similar to those disclosed in U.S. Pat. No. 5,818,189, which is incorporated herein by specific reference for all purposes, are battery powered wheels that employ either force and torque sensors, or both, to measure the force applied to the handrims from the user and amplify that force through the use of motors embedded in the wheels to drive the wheelchair forward or backward. This technology has been shown to have a number of positive effects on wheelchair users, including reduced energy expenditure, reduced push cadence, reduced muscle activation, decreased range of motion, easier hill climbing, increased propulsion speed and reduced pain during propulsion for those users already experiencing pain.

The drawback with this approach is that the employment of force and torque sensors to recognize and quantify the amplitude of the push significantly complicates the design. The handrims must be mounted to the wheel hubs, instead of the wheel rim as in typical manual wheelchairs, causing a significant increase in complexity. Added cost and weight of these devices then becomes inherent when this type of approach is taken. Additionally, because measurements are focused on the handrim, hazardous situations can be escalated by the assistive power.

Accordingly, there is a need for power assist system that addresses the issues of the prior art and devices.

SUMMARY OF INVENTION

In various exemplary embodiments, the present invention comprises a motion-based power assist system for manual wheelchairs. This power assist system uses the motion, including the angular and linear velocities and accelerations, of the power assist system in order to sense when a push is being performed on the handrims. The system uses different kinematic sensors, not force or torque sensors like the prior art, in order to measure when the wheelchair is accelerating past a certain minimal threshold, and recognizes that this is the result of the user performing a push. The system then provides an assistive force-pulse that is related to the experienced acceleration and velocity from propulsion.

By using the kinematics of the power assist system, the system will be able to recognize different situations and adjust its contribution to the user's propulsion to compensate. By measuring the kinematics of the power assist system, the present invention can recognize situations when the user is trying to stop, slow down, or is beginning to tip, and in response cut off all driving assistance. The use of the power assist system motion and kinematics as the input to the push activation control is novel. Prior art devices tend to add significant weight to the wheelchair, making it difficult to get the wheelchair into and out of a car for even the strongest user. Battery life is also an issue because the power assist wheels are simply too heavy to push around without the power assist.

In one exemplary embodiment of the invention, the aforementioned motion-based push activation is employed on a single drive wheel attachment that mounts to the axle of a wheelchair midway between the rear wheels. Attachment mounts are clamped to the axle and attach to the drive wheel attachment, allowing for quick connecting and releasing of the system for easy transport.

A separate embodiment employs the motion-based push activation on electric hub motors that are embedded in the rear drive wheels of a wheelchair. In using the motion of the wheelchair and its parts as the input for push activation, the handrims on the rear drive wheels can be directly mounted to the wheel rim, as on traditional non-power assist wheelchair wheels.

Another embodiment employs the said motion-based push activation on wheelchair mounted motors that drive the rear wheels of the wheelchair. This embodiment uses the same motion-based means to activate frame mounted motors, instead of the aforementioned wheel mounted motors, that in turn power the driven rear wheels for an assistive force to the wheelchair and user.

DETAILED DESCRIPTION OF EXEMPLARY EMBODIMENTS

In various exemplary embodiments, the present invention comprises a power assist system used on a manual wheelchair. Motion-based instrumentation measures the kinematics of the power assist system. The kinematics measured include, but are not limited to, linear velocities, angular velocities, linear accelerations, and angular accelerations. These parameters are quantified using a range of instruments, including but not limited to, gyroscopes, encoders, potentiometers, inertia measuring units, and multi-axis accelerometers. From these motion-based measurements, push activation can be recognized.

Figure 1:
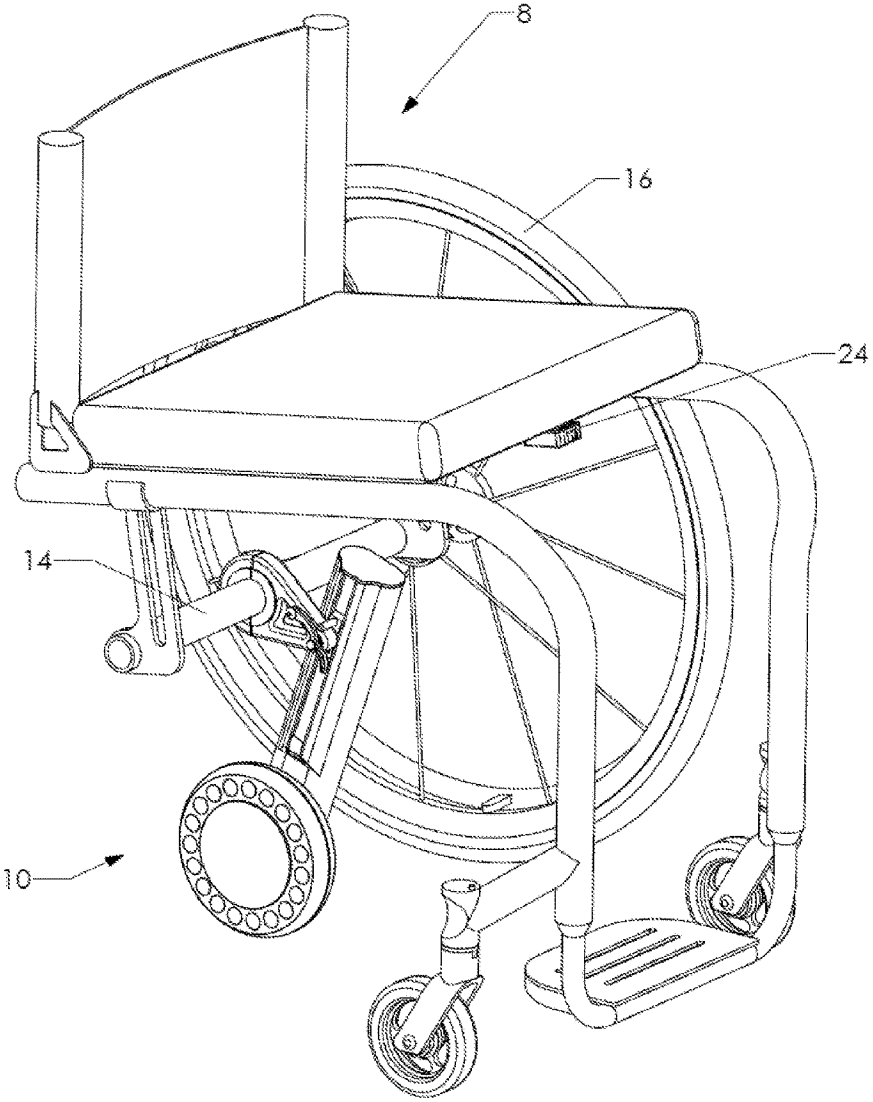
FIG. 1 shows an isometric view of an exemplary embodiment, a single drive wheel power assist attachment and remote control device mounted to a generic wheelchair. One of the rear wheels is removed for clarity.

The push activation recognition employs the principle that when the user is applying a push to the rim mounted handrim of typical wheelchair rear wheels 16 on a generic manual wheelchair 8, as shown in FIG. 1, the wheelchair rear wheels 16 are being accelerated by the user. If the rear wheels 16 are experiencing an angular acceleration then the wheelchair 8 and all onboard parts will experience acceleration. Because the wheelchair is accelerating, the power assist which is connected to it will also accelerate. If the power assist acceleration measurements are found to be above a threshold of approximately 1.5 m/s/s, a user push will be recognized. Similarly, if the power assist deceleration measurements are found to be below a threshold of approximately 1.5 m/s/s, a user brake will be recognized. The push recognition triggers the activation of an assistive power-pulse to help in the propulsion of the wheelchair 8 and the user that is performing the push. The power assist provided will be related to the manual power input as calculated from the motion-based sensors. In one approach, the power assist drive is set to the speed reached during the user's push. When user braking is detected, the provided power is discontinued.

Figure 2:
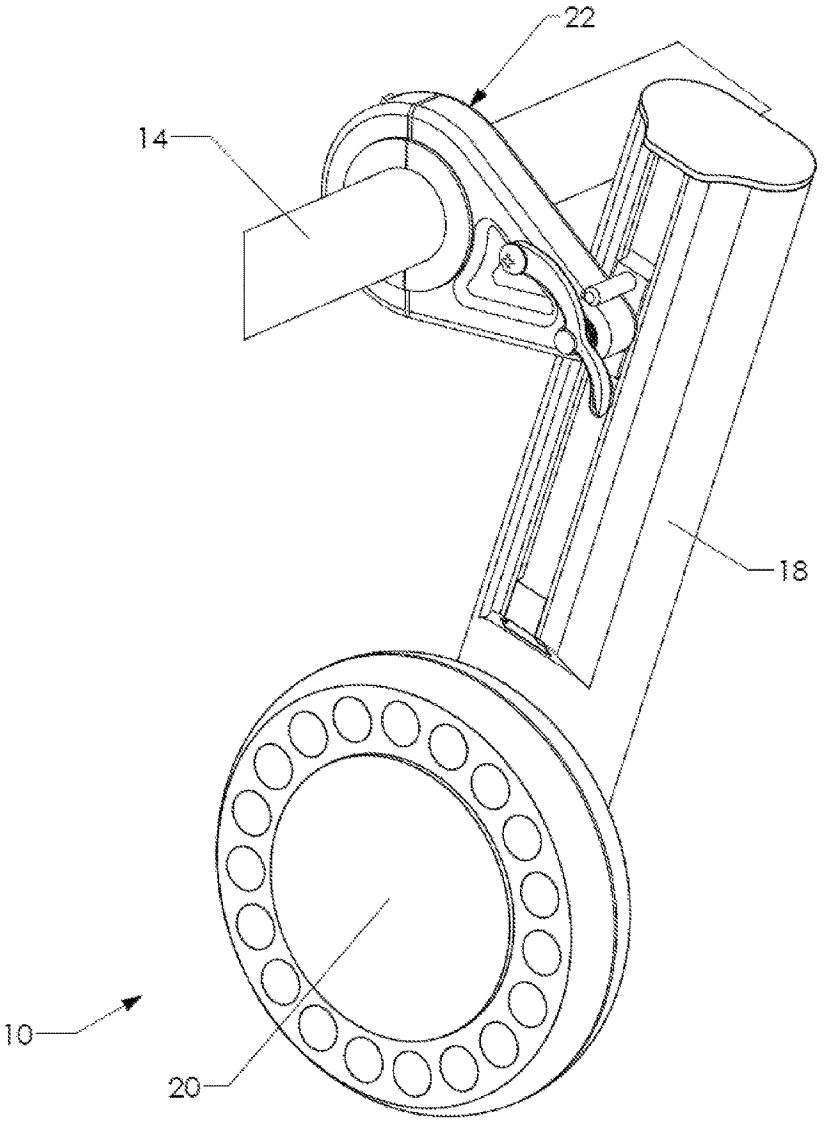
FIG. 2 shows an enlarged view of the single drive wheel power assist attachment of FIG. 1 mounted to the axle bar of a wheelchair frame.

FIGS. 1 and 2 show an embodiment of the power assist system employing the motion-based push activation. The power assist system, which in this embodiment comprises a single wheel power assist attachment 10, is shown mounted on a generic wheelchair 8, comprising a drive linkage 18, an electric hub drive wheel 20, a mounting attachment 22, and a remote control device 24.

The single wheel power assist attachment 10 is positioned between the wheelchair drive wheels 16 such that the electric drive wheel 20 contacts the ground at a point midway between the wheelchair drive wheels 16. This positioning prevents the wheelchair from turning or drifting when an assistive force is provided, while not significantly hindering the rotation of the chair when desired for maneuvering. The single wheel power assist attachment 10 and drive linkage 18 are also angled such that as the drive wheel power is increased, the wheel digs into the ground for ideal traction control.

The electric drive wheel 20 mounts to the distal end of the drive linkage 18, which is pivotally attached to the wheelchair axle bar 14 through the mounting attachment 22. While FIG. 1 and FIG. 2 show an embodiment with a singular mount attachment 22, in other embodiments a plurality or multitude of mounting attachments may be used to connect to the drive linkage 18. A remote control device 24 comprises part of the single wheel power assist attachment 10 to turn the unit on and modulate between multiple configuration settings for providing different amounts of driving force related to the sensed acceleration of the power assist system from the push of the user.

Figure 3:
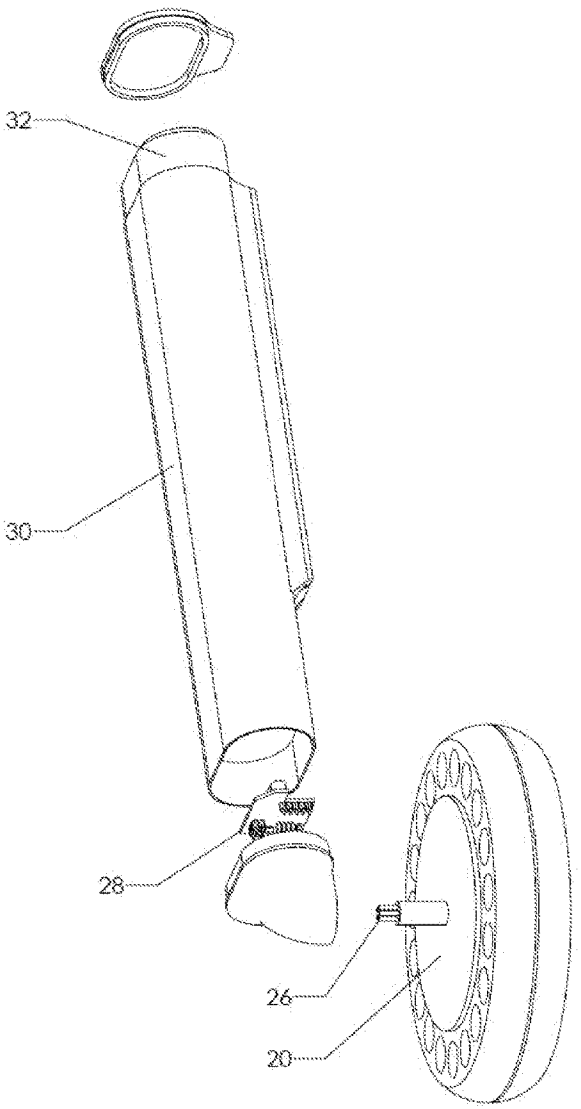
FIG. 3 shows an exploded assembly view of the single drive wheel power assist attachment of FIG. 1 removed from the wheelchair.

An exploded assembly of the power assist attachment 10 is shown in FIG. 3. The drive linkage 18 contains a shell or frame 30, a battery pack 32, custom printed circuit board 28, and electric hub motor 20. The primary role of the custom circuit board 28 is to receive sensor measurements, process those measurements to determine whether the users is pushing or braking, and then deliver the appropriate amount of power from the battery to the motor 20. Motion sensors can include inertial measurement units (gyroscopes, accelerometers and magnetometers) on the custom printed circuit board 28, rotational position sensors (optical encoders, Hall Effect sensors, or reed switches) in the drive motor 20, or inertial measurement units on the remote control device 24. Determining the linear acceleration of the wheelchair can be accomplished using several of these sensing modalities individually or with increased fidelity when done in combination to filter out any undesired motion artifacts, such as rolling over bumps or down slopes. The simplest method to derive linear acceleration of the wheelchair is to frequently sample the rotational position of the drive wheel 20 and differentiate discrete samples to derive the rotational speed and then differentiate rotational speed values to determine the rotational acceleration of the wheel. The linear acceleration of the wheelchair is directly related to the rotational acceleration of the drive wheel 20. Accelerations that occur when the power assist components are experiencing rapid changes in attitude (uphill/downhill angle) or vertical acceleration can be ignored as artifacts of environmental factors and not related to the user pushing or braking the wheelchair.

Sensor measurements and motor power is passed to and from the printed circuit board 28 by cables that pass though the motor axle 26. Sensor measurements and configuration information from the remote control device 24 is passed to the printed circuit board 28 wirelessly using any of a number of standard data transmission protocols.

Figure 4:
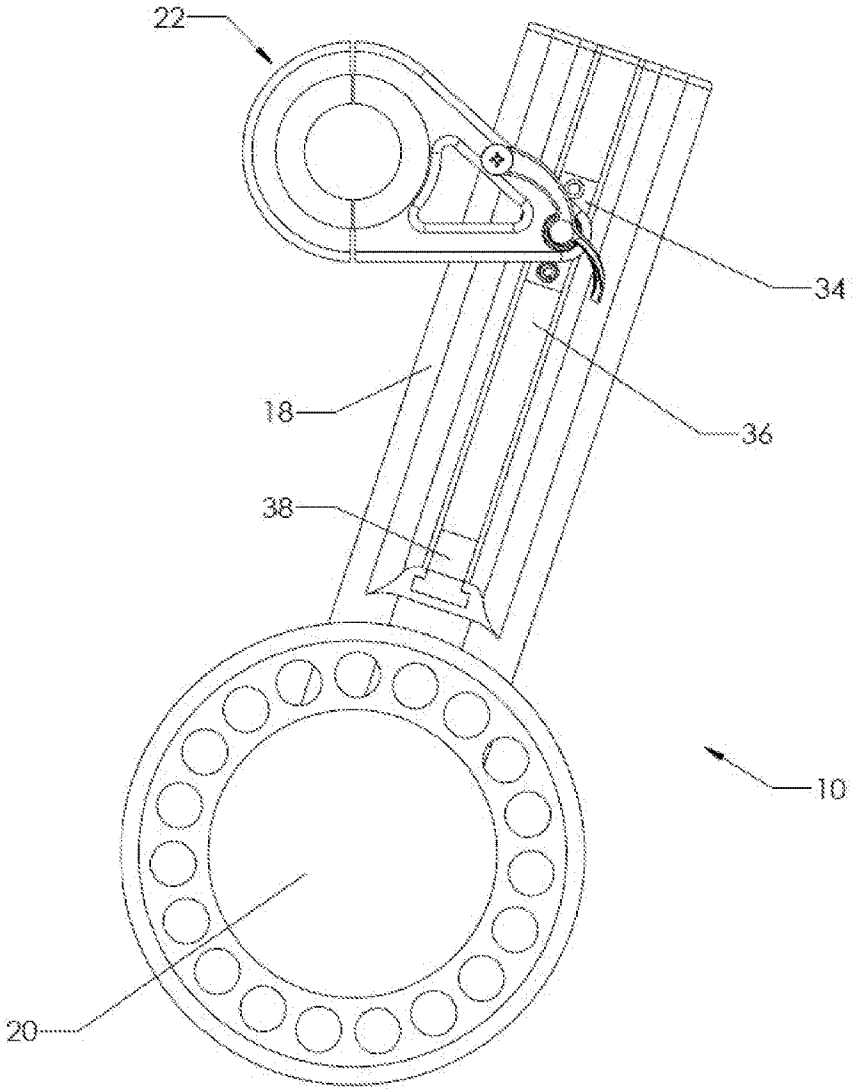
FIG. 4 shows an enlarged view of the single drive wheel power assist attachment of FIG. 1 mounted to the axle bar clamp, with the wheelchair removed for clarity.

The power assist unit 10 can be made to accommodate wheelchairs of varying rear wheel sizes by allowing the linkage pivot point to be adjusted along a slide pocket 36 in the drive linkage frame 30, as shown in FIG. 4. The pivot location can then be fixed by tightening machine screws in the pivot slider 34. The slide range can be limited using a stop in the slide track 38.

Figure 5:
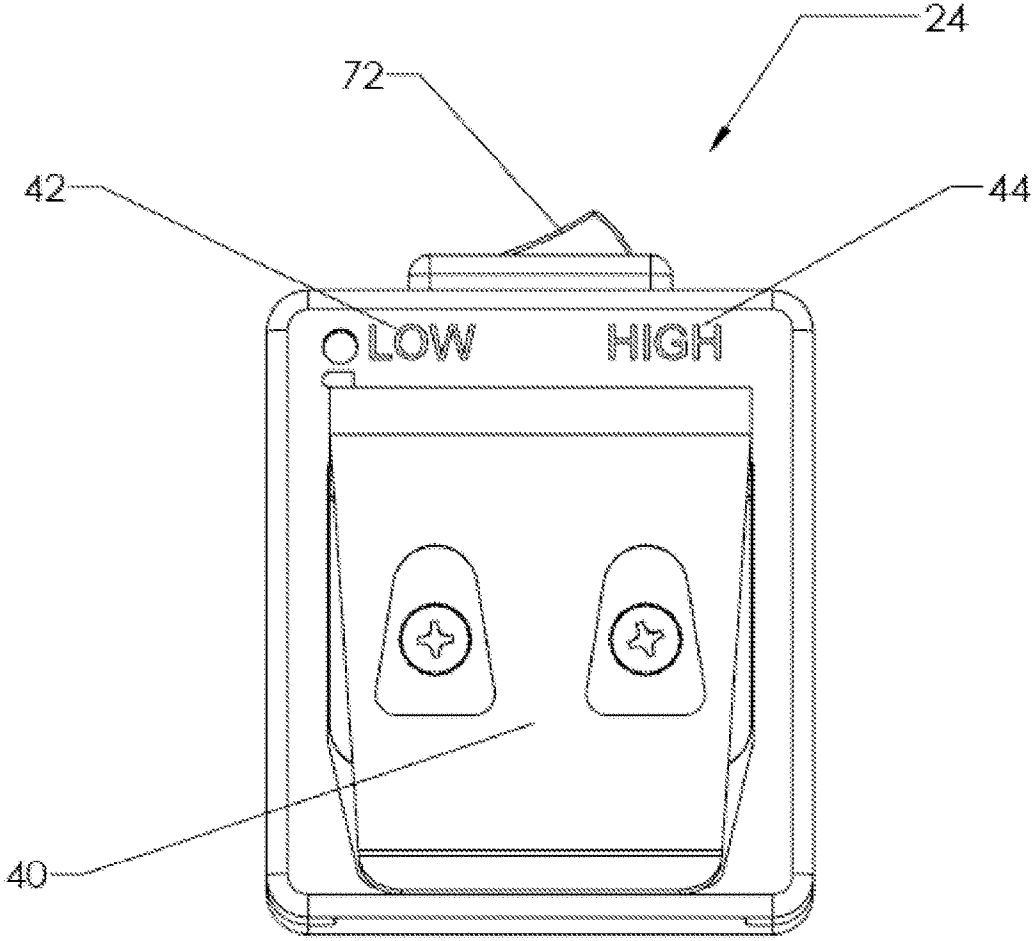
FIG. 5 shows the remote control device of FIG. 1 unclipped from the wheelchair seat upholstery.

The remote control device 24, shown removed from the wheelchair in FIG. 5, can be made to slide onto the seat upholstery using a simple spring clip 40. In this embodiment, it can be quickly installed onto a wheelchair without the use of tools and it can be easily removed when the power assist is not needed. The remote can be used to turn the unit on using a button or switch 72. Another use for the remote is to allow the user to select between various modes of operation, such as LOW 42 and HIGH 44. Low and high modes can serve to decrease or increase the level of power delivered to the motor for any applied push. This can be accomplished by altering the multiplier used in setting the motor power in response to a measured acceleration. In an alternate approach, low and high modes could be used to limit the maximum drive speed of the motor for indoor and outdoor use.

In another exemplary embodiment, motion-based push activation is used on two wheel hub motors incorporated into each of the wheelchair drive wheels. The design and operation of hub motors is well-known in the prior art. The motor assembly comprises a self-contained unit which includes a center shaft that fixable mounts the wheelchair to a stator. The motor housing has permanently mounted magnets and is rotationally driven by the push and pulling forces induced by the electrical excitation of the stator. The rotationally driven motor housing is connected to the tire supporting rim of the wheelchair wheel. The nature of this power assist system allows for the handrims to be directly mounted to the rim of the wheelchair drive wheels. As the user performs a push to the handrims, the wheelchair accelerates, activating the power assist through the motion-based recognition instrumentation.

The instrumentation and motion control processing is similar to the previously described embodiment. The primary difference is that the rotational position of the two rear wheels would be measured directly and averaged to yield a single rotational position, which would then be processed as previously described. Each rear wheel would communicate wirelessly with the other in order to exchange rotational position information. Each drive wheel would be set to the same drive speed setting at the same time. Similarly, power to each drive wheel would be discontinued at the same time when a braking event is detected.

In another embodiment, motion-based push activation is incorporated into a wheelchair frame fixed drive system. The wheelchair wheels are secured to the wheelchair as normally done. Drive motors are then affixed to the frame of the wheelchair and the output shafts are pressed into the rear wheel tires to effectively couple their rotations together. When a user pushes, the rear wheels along with the drive motor shafts accelerate and a push is recognized using the aforementioned sensing. The motor power is mechanically transferred to the rear wheels providing propulsion assistance. The mechanical means of transferring rotation from the drive motor to the rear wheels includes but is not limited to friction, gears, or belts, all of which is operationally well-known and need not be explained.

The foregoing description is that of certain exemplary embodiments, and various changes and adaptations can be made without departing from the scope of the invention. Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive.

What is claimed is:

1. A power assist system for wheelchairs with an axle, the power assist system comprising:

a motion sensing system comprising one or more motion-sensitive instruments configured to measure the motion of the power assist system; and a drive system comprising one or more electric motors, one or more drive wheels, and an axle mounting attachment, wherein the motion-sensitive instruments are further configured to measure a change in rotational position of the one or more drive wheels to determine the motion of the power assist system;

wherein the motion sensing system and the drive system are contained in a housing that is adapted to pivotally attach to an axle extending between two wheels of a wheelchair.

2. The system of claim 1, wherein the power assist system is configured to use the motion measurements to detect acceleration or deceleration of the power assist system.

3. The system of claim 2, wherein the power assist system activates the drive system to provide an assistive drive force based on the detected acceleration when the detected acceleration is above a predetermined threshold level.

4. The system of claim 3, wherein the level of assistive drive force is based upon the magnitude of the detected acceleration.

5. The system of claim 4, wherein the proportion of the assistive drive force is modulated between different configuration settings.

6. The system of claim 1, further comprising a drive linkage attached to said one or more drive wheels, and pivotally attached to the axle mounting attachment via an adjustable slide pocket in a drive linkage frame.

7. The system of claim 1, wherein said one or more drive wheels make contact with the ground.

8. The system of claim 1, further comprising a remote control device.

9. The system of claim 1, wherein the drive system is mounted on the wheelchair axle such that the one or more drive wheels contacts the ground at a point behind the axle.

10. The system of claim 1, wherein the motion sensing system is further configured to:

determine a rotational speed of the drive wheel based on the change in rotational position of the one or more drive wheels; and determine a linear acceleration of the power assist system based on the rotational speed.

11. The system of claim 10, wherein the motion sensing system is further configured to determine a linear acceleration of the wheel chair based on the linear acceleration of the power assist system.

12. The system of claim 1, wherein the motion sensitive instrument comprises one of a Hall Effect sensor or a reed switch.

13. A power assist system for wheelchairs with an axle, the power assist system contained within a housing adapted to attach to the axle and comprising:

a motion sensing system comprising one or more motion-sensitive instruments configured to measure a change in rotational position of one or more drive wheels to determine the motion of the power assist system; and a drive system configured to provide an assistive drive force via the one or more drive wheels based on motion measured by the motion sensing system exceeding a predetermined threshold value.

14. The system of claim 13, further comprising a circuit configured to:

receive and process measurements from the motion sensing system; and provide command signals to the drive system based on the measurements.

15. The system of claim 14, wherein the motion measured by the motion sensing system is acceleration or deceleration, the circuit configured to determine acceleration or deceleration of the power assist system based on the measurements.

16. The system of claim 15, wherein the circuit is configured to activate the drive system to provide an assistive drive force when acceleration exceeding a predetermined threshold acceleration value and to deactivate the drive system when the deceleration falls below a predetermined deceleration value.

17. The system of claim 13, wherein the drive system further comprises one or more electric motors, the one or more drive wheels, and the axle mounting attachment.

18. A power assist system for wheelchairs with an axle, the power assist system comprising a housing adapted to pivotally attach to an axle extending between two wheels of a wheelchair via an axle mounting attachment, the housing containing:

one or more batteries;

one or more electric motors;

a drive system comprising one or more drive wheels; and a circuit comprising one or more motion-sensitive instruments configured to:

measure a change in rotational position of the one or more drive wheels to determine the motion of the power assist system; and activate the drive system to provide an assistive drive force via the one or more drive wheels based on the determined motion.

19. The system of claim 18, wherein the circuit is further configured to:

determine a speed of the power assist system during the change in rotational position; and control the drive system to provide the assistive drive force via the one or more drive wheels to achieve the speed.

* * * * *